United States Patent [19]

Tong

[11] Patent Number: 4,499,051

[45] Date of Patent: Feb. 12, 1985

[54] PITTING RESISTANT ALUMINUM ALLOYS

[75] Inventor: Hua S. Tong, Morris Township, Morris County, N.J.

[73] Assignee: Revere Copper and Brass Incorporated, New York, N.Y.

[21] Appl. No.: 501,266

[22] Filed: Jun. 6, 1983

[51] Int. Cl.[3] ..... C22C 21/00

[52] U.S. Cl. ..... 420/540; 420/550; 420/551; 420/553; 420/554; 148/437

[58] Field of Search ..... 420/554, 540, 541, 542-544, 420/546, 547, 548, 549, 550, 551, 553, 531-538; 148/437-440

[56] References Cited

U.S. PATENT DOCUMENTS 4,069,369 1/1978 Fedor et al. ..... 420/554

*Primary Examiner*—R. Dean

*Attorney, Agent, or Firm*—Pennie & Edmonds

[57] ABSTRACT

This invention relates to aluminum alloy compositions that have superior pitting corrosion resistance. These compositions include small amounts of manganese, lead, and bismuth, with the major constituent being aluminum. Elements such as titanium, zinc, cobalt, zirconium, and/or boron can also be added. The manganese content ranges from 0.20 to 2 weight percent, the lead content ranges from 0.02 to 0.4 weight percent and the bismuth content ranges from 0.02 to 0.2 weight percent. When included, the zinc content can range from 0.03 to 0.5 weight percent and the titanium content can range from 0.05 to 0.5 weight percent, the cobalt content can range from 0.03 to 0.2 weight percent, the zirconium content can range from 0.03 to 0.5 weight percent, and the boron content can range from 0.03 to 0.1 weight percent.

12 Claims, No Drawings

PITTING RESISTANT ALUMINUM ALLOYS

TECHNICAL FIELD

This invention relates to aluminum alloy compositions that have superior pitting corrosion resistance. These compositions are aluminum base and can include amounts of manganese, lead, and bismuth, as well as additional elements such as titanium, zinc, zirconium, cobalt, and/or boron, along with incidental impurities such as silicon, iron, magnesium, and copper.

BACKGROUND ART

Because of their light weight, atmospheric corrosion resistance and high strength-to-weight ratio properties, aluminum alloys are popular materials of construction and many different alloy compositions are well known in the art. A system of four digit numerical designations has been established to identify these aluminum alloys. The first digit signifies the primary alloying elements, while the other digits signify a particular grade or product form.

A popular class of alloys in this classification system is the 3XXX series, of which the 3003 and 3010 grades are representative. These alloys contain nominal amounts of manganese and magnesium, and are popular due to their relatively low cost, their ability to be easily cast or worked, and their mechanical properties (i.e., tensile and yield strengths), which are satisfactory for certain applications. In many situations, however, the 3XXX series does not provide sufficient corrosion resistance, particularly against solutions that cause pitting.

Pitting or pitting corrosion is the localized attack of a metal surface which is confined to a small area and which takes the form of cavities. The depth of these cavities can range from a few microns on the surface to throughout the entire thickness of the metal. Pitting is a particularly troublesome type of corrosion because, although most of the metal is not attacked, the deeper pits seriously weaken the metal and often cause premature failure of the part. While pitting corrosion is detrimental to any metal or finished part, it is a much greater concern when the metal has been fabricated or processed into thin shapes or gauges.

Pitting corrosion resistance can be improved by resorting to a higher alloy content composition, but in addition to increased cost, these higher alloys are more difficult to cast or fabricate into shapes.

When utilizing aluminum alloys in the form of thin shapes or small parts, there are many applications where increased mechanical properties would be beneficial or necessary. This can also be resolved by the substitution of a higher alloy composition, but, again, higher costs and fabrication difficulties will be encountered.

The present invention overcomes the deficiencies of the 3XXX series while avoiding the disadvantages of the higher alloy alternatives. Through a unique combination of small amounts of alloying elements, the compositions claimed in this invention provide substantially improved pitting corrosion resistance compared to the prior art.

An additional advantage of the aluminum alloy compositions of the present invention is better mechanical properties compared to the 3XXX series while retaining similar casting and working abilities. The aluminum alloys of the present invention can be readily fabricated by casting and either hot or cold rolling to thin gauges.

They can also be easily formed into shapes by drawing, stamping, or extruding.

Due to their tolerance for certain levels of impurity or tramp elements, the cost of manufacture of these compositions is relatively low and compares favorably to the cost of the 3XXX series alloys.

DISCLOSURE OF THE INVENTION

The present invention provides aluminum alloy compositions that have excellent pitting corrosion resistance, higher mechanical properties, and equal or better casting and working abilities when compared to conventional alloys.

The compositions of the present invention contain a novel and unique combination of manganese, lead, and bismuth which imparts the desired properties to these alloys. Also, small amounts of additional elements such as titanium, zirconium, cobalt, zinc, and/or boron can be included in these compositions with equal or better results. While the addition of various elements to aluminum is conventional, the combination and interaction of these selected elements in the particular ranges claimed is not conventional. Consequently, substantially improved pitting corrosion resistance and increased mechanical properties result when these compositions are manufactured or processed by conventional methods.

The foregoing improvements are achieved in the present invention by novel and unusual combinations of alloying element additions to ordinary aluminum base compositions. The present invention also retains its improved properties even when the alloys contain the incidental impurities which result from manufacturing operations.

Conventional aluminum alloys normally contain small amounts of iron, silicon, copper, and magnesium which are unintentionally introduced into the alloy during melting or casting operations. An advantage of the present invention is that it can tolerate certain levels of impurities without adversely affecting the improved pitting corrosion resistance or increased mechanical properties. This in turn allows the new compositions to be manufactured by lower cost conventional techniques rather than by special techniques to maintain very low residual impurity levels.

Regarding the acceptable impurity levels, it has been determined that either silicon or iron contents up to about 0.7 weight percent have no effect on the beneficial properties of the claimed aluminum compositions. Copper levels to 0.2 weight percent and magnesium levels to 0.3 weight percent can also be tolerated without any detrimental effects to the described properties.

Specifically, the invention comprises aluminum alloy compositions that contain from 0.2 to 2 weight percent manganese, 0.02 to 0.4 weight percent lead, and 0.02 to 0.2 weight percent bismuth, with the balance being essentially aluminum.

Additions of from 0.03 to 0.5 weight percent zinc, 0.05 to 0.5 weight percent titanium, 0.03 to 0.5 weight percent zirconium, or 0.03 to 0.2 weight percent cobalt, or additions of combinations of these elements in the ranges stated also contribute to or maintain the improved properties of the invention over the prior art. It is preferable for these additional alloying elements to be present alone or in combination in amounts of about 0.2 weight percent each.

Finally, from 0.03 to 0.1 weight percent boron can be added as a grain refiner to any of the above described alloys. The beneficial effects of boron additions are well known to persons skilled in the art, and such additions do not affect or change the improved properties of the present invention.

EXAMPLES

A further understanding of the present invention, and the advantages thereof, can be had by reference to the examples listed in Tables 1 and 2.

Samples of aluminum alloy compositions were prepared according to the teachings of the invention and given a strain hardening heat treatment before measuring mechanical properties (i.e., Tensile Strength, Yield Strength, and Elongation). These properties were compared to standard Aluminum Alloy 3003, which had also undergone the strain hardening heat treatment. All mechanical property test results are tabulated in Table 1 and they show that the new compositions have improved properties compared to prior art alloys.

Next, corrosion rates and pitting potentials were determined for the new alloys, AA 3003, and AA 3010 by immersing them in a solution of 0.01 Normal sulfuric acid which included an addition of 0.01 weight percent sodium chloride at a temperature of 22° C. for 168 hours. Nitrogen at 10 psi ($7\times10^4$ Pa) was bubbled into this solution throughout the test. The results of these tests, found in Table 2, show that most of the new compositions exhibited no pitting at all during corrosion testing whereas prior art alloys of the 3XXX series experienced heavy pitting attack.

These examples illustrate the present compositions and their improved properties, however, they are merely representative of the compositions disclosed and not considered to limit the present invention.

TABLE 1

| Example | Alloy (wt. %) | Ultimate Tensile Strength (MPa/ksi) | 0.2% Yield Strength (MPa/ksi) | Elongation % in 2 ins. |
|---|---|---|---|---|
| 1. | $Al_{bal}Mn_{1.0}Pb_{0.2}Bi_{0.1}Si_{0.1}Fe_{0.1}$ | 204/29.6 | 193/28.0 | 3.9 |
| 2. | $Al_{bal}Mn_{1.0}Pb_{0.2}Bi_{0.4}Si_{0.6}Fe_{0.5}Co_{0.2}$ | 216/31.3 | 203/29.5 | 4.3 |
| 3. | $Al_{bal}Mn_{1.0}Pb_{0.2}Bi_{0.2}Si_{0.7}Fe_{0.6}$ | 237/34.3 | 226/32.7 | 4.5 |
| 4. | $Al_{bal}Mn_{1.0}Pb_{0.02}Bi_{0.05}Fe_{0.7}$ | 231/33.5 | 214/31.0 | 4.5 |
| 5. | AA 3003 | 213/30.9 | 203/29.5 | 3.0 |

Note:
All the alloys were heat treated in accordance with H 16 designation which represents a strain hardening treatment.

TABLE 2

| Example | Alloy (wt %) | Corrosion Rate (mpy) | Extent of Pitting Observed |
|---|---|---|---|
| 1. | $Al_{bal}Mn_{1.0}Pb_{0.2}Bi_{0.1}Si_{0.1}Fe_{0.1}$ | 12.14 | None |
| 2. | $Al_{bal}Mn_{1.0}Pb_{0.2}Bi_{0.4}Si_{0.7}Fe_{0.7}Co_{0.2}$ | 9.51 | None |
| 3. | $Al_{bal}Mn_{1.0}Pb_{0.2}Bi_{0.2}Si_{0.7}Fe_{0.7}$ | 12.91 | None |
| 4. | $Al_{bal}Mn_{1.0}Pb_{0.02}Bi_{0.05}Si_{0.7}Fe_{0.7}$ | 10.20 | Very slight |
| 5. | AA 3003 | 11.93 | Heavy |
| 6. | AA 3010 | 14.19 | Moderate |

Note:
The corrosion data was determined by immersing the alloys in a solution of 0.01N $H_2SO_4$ + 0.01% NaCl at 22° C. for 168 hours, with nitrogen gas bubbled through the solution.

Having thus described my invention, what I claim as new and desire to secure by Letters Patent is:

1. An aluminum alloy composition consisting essentially of 0.2 to 2 weight percent manganese, 0.02 to 0.4 weight percent lead, and 0.02 to 0.2 weight percent bismuth, with the balance being essentially aluminum.

2. The composition according to claim 1 wherein said composition contains at least one of the elements selected from the group consisting of (a) 0.03 to 0.05 weight percent zinc,
(b) 0.05 to 0.5 weight percent titanium,
(c) 0.03 to 0.2 weight percent cobalt,
(d) 0.03 to 0.5 weight percent zirconium, and
(e) 0.03 to 0.1 weight percent boron.

3. The composition according to claim 1 wherein said composition contains 0.03 to 0.5 weight percent zinc, and at least one of the elements selected from the group consisting of (a) 0.05 to 0.5 weight percent titanium,
(b) 0.03 to 0.2 weight percent cobalt,
(c) 0.03 to 0.5 weight percent zirconium, and
(d) 0.03 to 0.1 weight percent boron.

4. The composition according to claim 1 wherein said composition contains 0.03 to 0.5 weight percent zinc, 0.03 to 0.2 weight percent cobalt, and at least one of the elements selected from the group consisting of (a) 0.05 to 0.5 weight percent titanium,
(b) 0.03 to 0.5 weight percent zirconium, and
(c) 0.03 to 0.1 weight percent boron.

5. The composition according to claim 1 wherein said composition contains 0.03 to 0.5 weight percent zinc, 0.05 to 0.5 weight percent titanium, 0.03 to 0.2 weight percent cobalt, and at least one of the elements selected from the group consisting of (a) 0.03 to 0.5 weight percent zirconium, and
(b) 0.3 to 0.1 weight percent boron.

6. The composition according to claim 1 wherein said composition contains 0.03 to 0.1 weight percent boron, 0.03 to 0.5 weight percent zirconium, 0.03 to 0.2 weight percent cobalt, 0.05 to 0.5 weight percent titanium, and 0.03 to 0.5 weight percent zinc.

7. An aluminum alloy composition consisting essentially of about 1 weight percent manganese, about 0.2 weight percent lead, about 0.4 weight percent bismuth, and at least one element selected from the group consisting of (a) about 0.2 weight percent zinc,
(b) about 0.2 weight percent titanium,
(c) about 0.2 weight percent cobalt,
(d) about 0.2 weight percent zirconium, and
(e) about 0.1 weight percent boron, with the balance being essentially aluminum.

8. A thin sheet of aluminum having enhanced pitting corrosion resistance which comprises mixing with aluminum prior to formation into the sheet an amount of about 0.2 to 2 weight percent manganese, about 0.02 to 0.4 weight percent lead, and about 0.02 to 0.2 weight percent bismuth to form an aluminum alloy.

9. The sheet according to claim 8 wherein at least one of the elements selected from the group consisting of (a) 0.03 to 0.5 weight percent zinc,
(b) 0.05 to 0.5 weight percent titanium,
(c) 0.03 to 0.2 weight percent cobalt,
(d) 0.03 to 0.5 weight percent ziconium, and
(e) 0.03 to 0.1 weight percent boron is mixed with the aluminum prior to formation into the sheet.

10. The sheet according to claim 9 wherein said aluminum alloy is resistant to pitting from dilute acid solutions.

11. The sheet according to claim 10 wherein said aluminum alloy is resistant to pitting from dilute sulfuric acid solutions.

12. The sheet according to claim 11 wherein said aluminum alloy is resistant to pitting from dilute sulfuric acid solutions containing chloride ions.

* * * * *